United States Patent [19]

Müller et al.

[11] Patent Number: 5,019,159

[45] Date of Patent: May 28, 1991

[54] PROCESS AND APPARATUS FOR THE INTRODUCTION OF GAS INTO A DISCHARGE OPENING OF A METALLURGICAL CONTAINER CONTAINING MOLTEN METAL

[75] Inventors: Bruno Müller, Muhen; Rolf Waltenspühl, Hünenberg, both of Switzerland

[73] Assignee: Stopinc Aktiengesellschaft, Baar, Switzerland

[21] Appl. No.: 350,472

[22] PCT Filed: Oct. 18, 1988

[86] PCT No.: PCT/EP88/00934

§ 371 Date: May 5, 1989

§ 102(e) Date: May 5, 1989

[87] PCT Pub. No.: WO89/05700

PCT Pub. Date: Jun. 29, 1989

[30] Foreign Application Priority Data

Dec. 24, 1987 [CH] Switzerland ..... 05065/87

[51] Int. Cl.[5] ..... C21C 7/00

[52] U.S. Cl. ..... 75/533; 222/603; 222/593; 75/528

[58] Field of Search ..... 222/603, 590, 592, 593; 266/220, 138, 45; 75/525, 533, 528

[56] References Cited

U.S. PATENT DOCUMENTS

| | | | |
|---|---|---|---|
| 4,207,094 | 6/1980 | Diener et al. | 75/525 |
| 4,732,607 | 3/1988 | Sugimori et al. | 75/525 |
| 4,746,038 | 5/1988 | Ohwada et al. | 222/603 |

FOREIGN PATENT DOCUMENTS

| | | | |
|---|---|---|---|
| 1165627 | 11/1953 | Fed. Rep. of Germany . | |
| 2732340 | 7/1977 | Fed. Rep. of Germany . | |
| 2760353 | 7/1977 | Fed. Rep. of Germany . | |
| 2836409 | 8/1978 | Fed. Rep. of Germany . | |
| 3404836 | 8/1984 | Fed. Rep. of Germany | 222/603 |
| 1062591 | 3/1967 | United Kingdom . | |
| 2094954 | 9/1982 | United Kingdom . | |
| 2173726 | 10/1986 | United Kingdom | 222/603 |

*Primary Examiner*—S. Kastler

*Attorney, Agent, or Firm*—Wenderoth, Lind & Ponack

[57] ABSTRACT

For the procedure a gas, heated to at least 1000 degrees Celsius, preferably even beyond the liquid temperature of the melt, is blown into the discharge opening (26). In this manner freezing problems and deposits in the discharge opening can be largely prevented. The pouring sleeve (20) according to the invention has a gas supply line (21), leading into a gas permeable insert (23) surrounding the opening (26), which is led for a certain length along the upper range of the sleeve (20) which is in contact with the melt, for the purpose of heating the gas.

26 Claims, 2 Drawing Sheets

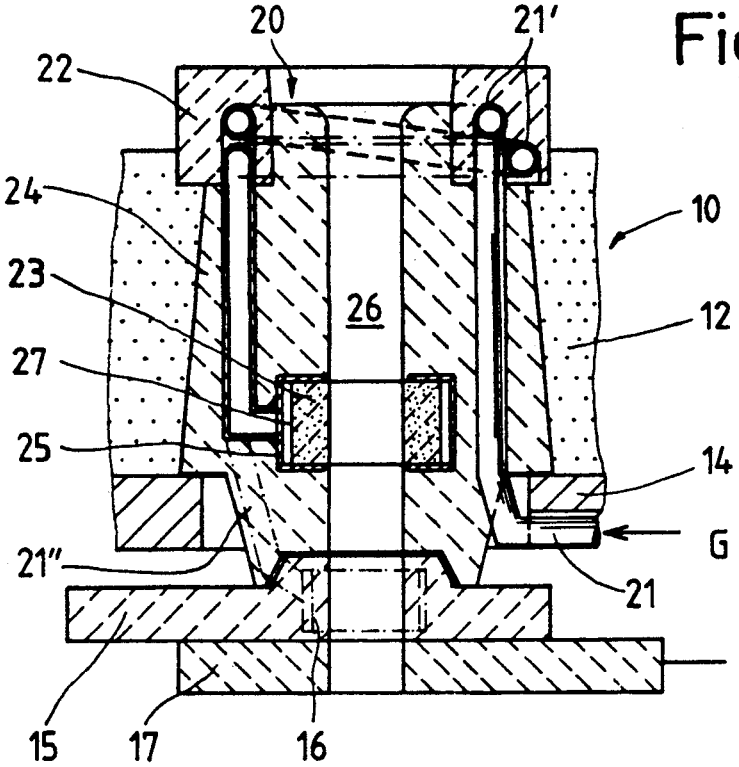
Fig.1
Fig.2
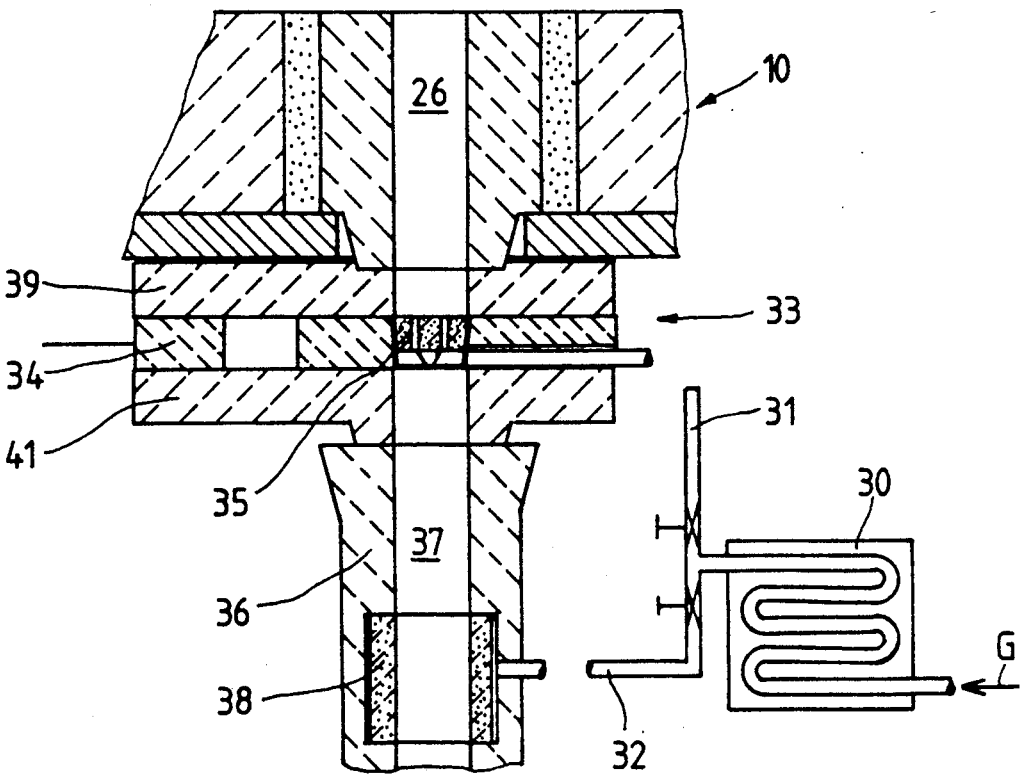

Fig.3
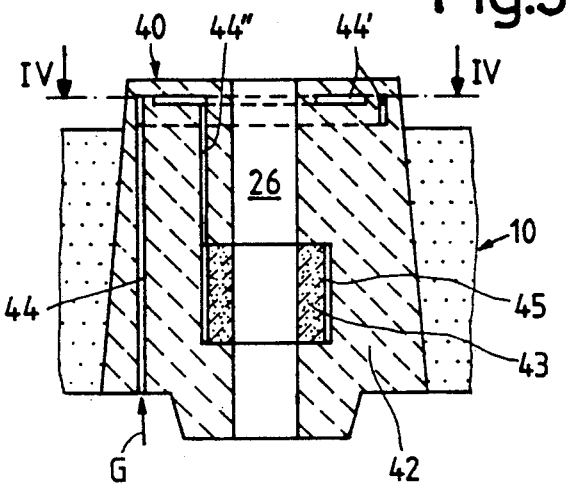
Fig.5
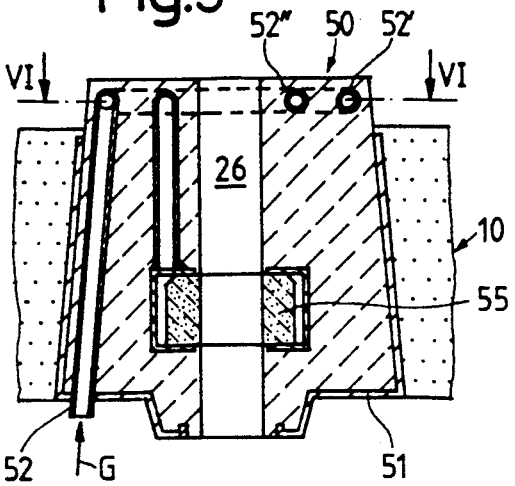
Fig.4
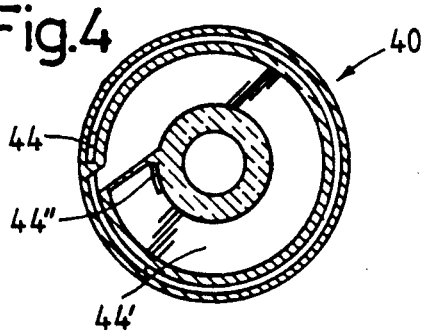
Fig.6
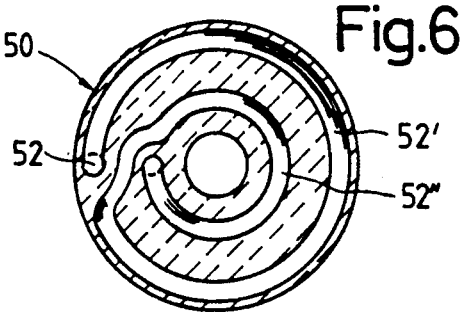
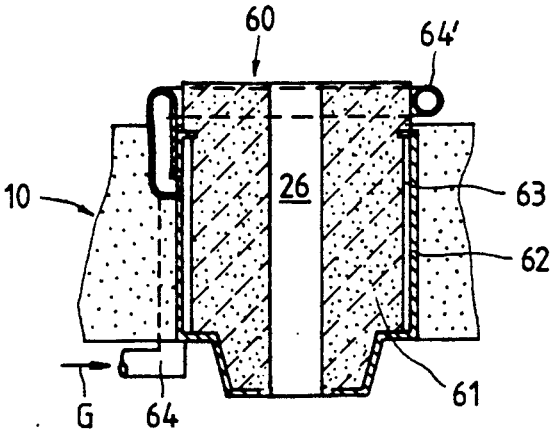
Fig.7
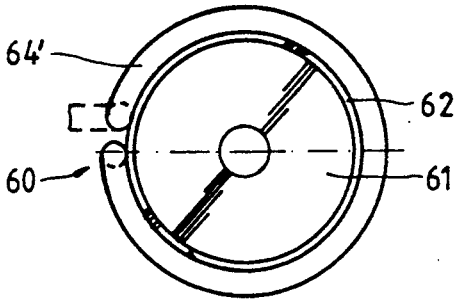
Fig.8

PROCESS AND APPARATUS FOR THE INTRODUCTION OF GAS INTO A DISCHARGE OPENING OF A METALLURGICAL CONTAINER CONTAINING MOLTEN METAL

The invention concerns a procedure for the introduction of gas into a discharge opening of a matallurgical container in order to prevent or reduce deposits or freezing in the discharge opening, as well as a discharge sleeve for executing the procedure.

During the pouring particularly of metal melts from steel pouring ladles or spreaders, particularly aluminum killed steel has a tendency to form alumina deposits in the discharge opening, which lead to obstructions and early discontinuation of pouring. According to DE-PS No. 35 06 426 it has been known to fight such deposits with the introduction of gas. The gas there is blown in at room temperature with a constant gas stream or also in a pulse like manner.

In another procedure of the generic type (DE-PS No. 28 36 409 ), in which a slide lock is arranged at the discharge opening of the container, a flush gas is blown into the discharge opening through the slide plate with closed lock in order to prevent the freezing of the melt in the opening.

In practice it has been possible to deal with this problem with more or less success with the use of these known procedures.

Starting from this, the current invention is based on the problem to improve the gas introduction in such a manner that the cited deposits or freezing in the discharge opening can be prevented in a simple manner for the duration of the required pouring time.

According to the invention this problem has been solved due to the fact that the gas is heated before entering the discharge opening to at least 1000 degrees Celsius, preferably even beyond the liquid temperature of the metal melt. In this manner the pouring times or temporary closing times can be extended practically as long as desired without any pouring disruptions.

Due to the blowing in of heated gas, the melt in the discharge opening during the pouring does not undergo any appreciable cooling into the temperature range suitable for alumina precipitation or even a clinging to the opening wall due to gelling of the melt.

With the use of a slide lock at the discharge of the container it is possible to completely prevent, in a locked position of the closure, a freezing of the melt in the discharge opening by blowing in heated gas through a locking plate into the discharge opening, provided the gas temperature is above the liquid temperature of the melt.

In the procedure according to the invention the preferred gas to us is an inert gas, such as argon to a gas-solid matter mixture.

The gas can be heated by means of an external heating device or by a discharge sleeve according to the invention in which the cold gas is led for a certain distance through a gas supply line in the upper area of the sleeve which is in contact with the metal melt and is then blown into the melt through a gas permeable insert surrounding the discharge opening. In this manner the gas is heated without problem to beyond the melting point of the melt and a freezing as well as a possible alumina deposit at the opening wall can be prevented for the whole required pouring time.

Advantages of further variations of the discharge sleeves according to the invention are explained in the following description.

It is certainly also possible that heated gas can be blown in a suitable manner into the extended discharge opening, formed by a pouring tube, or through a locking plate.

Embodiments of the invention are explained below based on the drawing. Shown is:

FIG. 1 A procedure according to the invention based on a pouring sleeve arranged in the discharge opening of the container and shown in lengthwise section, FIG. 2 a procedure according to the invention, applied with a slide lock, in locked position, arranged on the discharge, FIG. 3 variation of a pouring sleeve in lengthwise section, FIG. 4 cross section of the pouring sleeve according to FIG. 3 on the line IV—IV, FIG. 5 further variation of a pouring sleeve in lengthwise section, FIG. 6 cross section of the pouring sleeve according to FIG. 5 on the line VI—VI, FIG. 7 fourth variation of a pouring sleeve in lengthwise section and FIG. 8 topview of the sleeve according to FIG. 7.

Shown in FIG. 1 is the discharge area of a container 10, containing a metal melt, in which the discharge is formed by a fireproof discharge sleeve 20, to which schematically shown fireproof locking plates 15 and 17 of an actually known slide lock are connected. The partially shown container 10 can be, for example, a steel pouring ladle or a spreader and essentially consists of a steel casing 14 and a fireproof inside lining 12 into which the discharge sleeve 20 is embedded. By means of the lower locking plate 17, pressed against the upper locking plate 15, it is possible to pour the amount of melt in a regulated manner by shifting said plate. In the shown position, in which the openings of the locking plates 15 and 17 are the same as the discharge opening 26, the lock is fully opened.

The pouring sleeve 20 of fireproof material has an annular gas permeable insert 23 which surrounds the discharge opening 26 and is surrounded at its circumference by a metal capsule 25, whereby an annular gap 27 is provided in between which permits an even distribution of the gas coming from the gas supply line 21. For the heating of the gas to be blown into the discharge opening 26 according to the invention, the gas supply line 21 is led into the upper range of the pouring sleeve 20, there led in a coil-like manner around the discharge opening 26 and then led heated through the insert 23 into the melt to be poured. The gas supply line 21', constructed in a coil-like manner in the upper range of the pouring sleeve 20, is embedded into a fireproof extension 22, consisting of well heat conducting material, e.g., electro-graphite which is glued to the sleeve. During the time the blown in gas remains in this extension 22 which is in contact with the metal melt and very rapidly assumes the temperature of the melt, the gas is also very rapidly heated to a temperature which is almost the same as that of the melt. For this purpose the gas supply line 21 consists of a highly heat resistant steel or a fireproof ceramic tube.

In particular for preventing the freezing in the discharge opening 26 with closed slide lock, the gas heated in the pouring sleeve 20 is led through an additional line 21'', shown only by a dot-dash line in FIG. 1, to a gas permeable insert 16 which is embedded in the upper locking plate 15 and surrounds the discharge opening 26 and from there blown into the discharge opening 26. In this manner it is possible to successfully prevent a freezing of the melt in this opening, for example, during a temporary closing of the lock for the purpose of exchanging the pouring tube or other reasons.

According to FIG. 2 the heated gas is introduced, also for a prevention of freezing with a closed slide lock 33, only shown schematically, through a gas permeable stopper 35 which is mounted in a sliding plate 34 and gets under the discharge opening 26 in a locked position. For this purpose the gas is led from a not shown gas source G through a heating device 30 and a heat resistant gas supply line 31 into the stoper 35, whereby the latter has borings for an effective blowing in. In a corresponding manner, the inserts surrounding the discharge opening can also contain such borings.

With an opened lock 33 the procedure according to the invention can, depending on the application, also be used with a pouring tube 36, connected to the lock 33, the discharge opening 37 of which has an insert 38. The gas is heated in the heating device 30 and led through a heat resistant line 32 into this insert 38 and thus into the discharge opening. The heating device 30 is also only shown schematically and may be a known flow heater. The slide lock 33 is arranged on the discharge of the container 10 and essentially consists of three fireproof plates 34, 39 and 41, whereby the upper and the lower plate 39 and 41 are fixed, while the center plate 34 is led in a longitudinally shiftable manner.

A variation of a pouring sleeve 40 in container 10 according to FIG. 3 and FIG. 4 consists of a fireproof body 42 and an in it embedded porous insert 43. The porous insert 43 again surrounds the discharge opening 26. The gas supply G is done through the slit line 44, molded into the sleeve 40, which again is led into the upper sleeve area. The line 44 comprises a first and a second annular slit 44' around the discharge opening 26 and a slit 44", led in an open space 45 surrounding the insert 43. In this variation too, it is possible to heat the gas to the required temperature.

FIG. 5 and FIG. 6 show a pouring sleeve 50, embedded in the container 10 as another variation of the invention. This sleeve 50 is a fireproof concrete poured in a sheet metal casing 51. The gas supply G is through a line 52, poured into the sleeve, which is again led in the upper part of the sleeve 50 in a coil-like manner around the discharge opening 26 and from there into a porous insert 55 with a sheet metal casing, which is also molded into the casing. Here too, the remainder time in coils 52' and 52" is sufficient for the heating of the gas.

The pouring sleeve 60 shown in FIG. 7 and FIG. 8, consists of a fully porous fireproof body 61 with a discharge opening 26 and a sheet metal casing 62 surrounding the body 61. Between the body 61 and the sheet metal casing 62 an annular space 63 is provided into which the heated gas is led through a line 64, connected to the gas supply G. The gas supply line 64 has a loop 64' which is in contact with the metal melt outside and around the sleeve 61 and thus consists of a fireproof ceramic tube.

The invention can also very well be applied to non-iron metals, such as aluminum melts where the melting temperature is relatively low and thus the gas does not have to be heated so high. The described pouring sleeves can also be actually known perforated brick mounted with mortar into the steel pouring ladles.

What is claimed is:

1. In a process of introducing gas into a discharge opening of a metallurgical vessel containing molten metal, the improvement comprising preventing or reducing the formation in said discharge opening of deposits from the molten metal and the freezing of the molten metal in said discharge opening by:

prior to introducing said gas into said discharge opening, heating said gas to a temperature of at least 1000°C.

2. The improvement claimed in claim 1, comprising introducing said gas into said discharge opening with said gas heated to a temperature above the liquidus temperature of the molten metal.

3. The improvement claimed in claim 1, comprising introducing said gas into said discharge opening by blowing said gas through a gas permeable insert surrounding said discharge opening.

4. The improvement claimed in claim 3, wherein said insert is positioned within a refractory discharge sleeve defining said discharge opening and fitted within the metallurgical vessel.

5. The improvement claimed in claim 4, wherein said heating comprises passing said gas through a passage at an inner end of said discharge sleeve in contact with the molten metal in the metallurgical vessel.

6. The improvement claimed in claim 5, wherein said passage is located within said inner end of said discharge sleeve.

7. The improvement claimed in claim 5, wherein said passage surrounds said inner end of said discharge sleeve.

8. The improvement claimed in claim 6, wherein said insert is positioned within a plate of a slide gate mounted on the metallurgical vessel to selectively open and close said discharge opening.

9. The improvement claimed in claim 8, wherein said plate is a stationary plate of said slide gate.

10. The improvement claimed in claim 8, wherein said plate is slidable plate of said slide gate.

11. The improvement claimed in claim 1, comprising heating said gas by means of a heating device external of the metallurgical vessel.

12. The improvement claimed in claim 1, comprising heating said gas by means of a heat exchange medium.

13. The improvement claimed in claim 1, comprising introducing said gas into said discharge opening by blowing said gas through a porous discharge sleeve difining said discharge opening and fitted within the metallurgical vessel.

14. The improvement claimed in claim 13, wherein said heating comprises passing said gas through a passage positioned outwardly of said discharge sleeve.

15. The improvement claimed in claim 14, wherein a portion of said passage is located at an inner end of said discharge sleeve in contact with the molten metal in the metallurgical vessel.

16. The improvement claimed in claim 1, wherein said gas is an inert gas.

17. The improvement claimed in claim 1, wherein said gas is a gas-solid mixture.

18. In a refractory discharge sleeve to be mounted in a metallurgical vessel to contain molten metal, said discharge sleeve having therethrough a discharge opening for discharging the molten metal from the vessel, a gas permeable member surrounding at least a portion of said discharge opening, and means for supplying gas to said gas permable portion such that the gas permeates therethrough and is introduced into said discharge opening, the improvement comprising means for preventing or reducing the formation in said discharge opening of deposits from the molten metal and freezing of the molten metal in said discharge opening, said preventing or reducing means comprising:

means for, prior to introduction of the gas into said discharge opening, heating the gas to a temperature of at least 1000°C., said heating means comprising a portion of said supplying means upstream of said gas permeable portion being located at an inner end of said discharge sleeve to be in contact with the molten metal in the metallurgical vessel.

19. The improvment claimed in claim 18, wherein said portion of said supplying means is formed as a coil surrounding said discharge opening.

20. The improvment claimed in claim 18, further comprising a refractory annular extension mounted on said inner end of said discharge sleeve such that said annular extension is to be in contact with the molten metal, said annular extension being formed of a highly heat conductive material, and said portion of said supplying means extends through said annular extension.

21. The improvement claimed in claim 19, wherein said material of said annular extension is electro-graphite.

22. The improvement claimed in claim 18, wherein said portion of said supplying means comprises a refractory ceramic tube surrounding said inner end of said discharge sleeve and to be contacted by the molten metal.

23. The improvement claimed in claim 18, wherein said portion of said supplying means is embedded in the material of said discharge sleeve.

24. The improvement claimed in claim 18, wherein said portion of said supplying means comprises channels formed in the material of said discharge sleeve.

25. The improvement claimed in claimed 18, wherein said gas permeable member comprises an annular gas permeable insert embedded in the material of said discharge sleeve.

26. The improvement claimed in claim 18, wherein said discharge sleeve is entirely formed of porous material forming said gas permeable member, and further comprising a metal casing peripherally surrounding said porous discharge sleeve.

* * * * *